US005229980A

United States Patent [19]

Pawela

[11] Patent Number: 5,229,980

[45] Date of Patent: Jul. 20, 1993

[54] BROADBAND ELECTROACOUSTIC TRANSDUCER

[75] Inventor: Theodore J. Pawela, Jackson, Mich.

[73] Assignee: Sparton Corporation, Jackson, Mich.

[21] Appl. No.: 889,051

[22] Filed: May 27, 1992

[51] Int. Cl.[5] ..... H04R 17/00

[52] U.S. Cl. ..... 367/157; 367/159; 367/162; 367/166; 310/334; 310/337

[58] Field of Search ..... 310/334, 369, 337; 367/155, 157, 158, 159, 164, 165, 162, 166, 163, 174

[56] References Cited

U.S. PATENT DOCUMENTS

| | | | |
|---|---|---|---|
| 2,775,749 | 12/1956 | Sussman | 367/158 |
| 3,111,595 | 11/1963 | Junger | 310/321 |
| 3,474,403 | 10/1969 | Massa et al. | 310/369 |
| 3,716,828 | 2/1973 | Massa | 310/369 |
| 3,972,018 | 7/1976 | Erickson | 310/337 |
| 4,156,824 | 5/1979 | Pence, Jr. | 310/321 |
| 4,220,887 | 9/1980 | Kompanek | 310/334 |
| 4,823,041 | 4/1989 | Inoue et al. | 367/155 X |
| 4,823,327 | 4/1989 | Hilmers | 310/337 |

*Primary Examiner*—J. Woodrow Eldred

*Attorney, Agent, or Firm*—Reising, Ethington, Barnard, Perry & Milton

[57] ABSTRACT

A broadband electroacoustic transducer is disclosed which provides an improved response over a relatively broad range of frequencies. The transducer includes a plurality of tines extending between the outer circumferential surfaces of a pair of piezoelectric cylinders. The cylinders are disposed about a common axis and are separated by a gap. The tines extend longitudinally across the gap from one cylinder to the other. Each tine is separated from the adjacent tines by a space which is sized to prevent contact between the tines when the cylinders radially oscillate. A pre-stress wrap is disposed over the tines on both sides of the gap to provide a static, inwardly radial force on the cylinders.

12 Claims, 2 Drawing Sheets

BROADBAND ELECTROACOUSTIC TRANSDUCER

FIELD OF THE INVENTION

The present invention relates generally to transducers and, more particularly, to an electroacoustic transducer which provides an improved broadband response.

BACKGROUND OF THE INVENTION

Electroacoustic transducers are commonly used in a variety of underwater applications, including acoustical communication, underwater survey, and sound detection. Such transducers are commonly made from a piezoelectric element which operates to convert between mechanical energy in the form of a compressive, expansive, or shear force and an electrical potential which appears across different parts of the piezoelectric element. Thus, when a piezoelectric element vibrates under the force of an acoustic wave, a resulting alternating electric potential indicative of the acoustic wave is induced across the piezoelectric element. Conversely, an alternating electric potential applied across a piezoelectric element will cause the piezoelectric element to vibrate, thereby producing an acoustic wave at a frequency dependent upon the frequency of the applied electric potential and the characteristics of the piezoelectric element. In this way, electroacoustic transducers can be used to send and/or receive acoustical information.

Piezoelectric elements of varying geometries can be utilized for electroacoustic conversion. See, for example, U.S. Pat. No. 3,972,018, issued Jul. 17, 1976 to D.J. Erickson. One type of piezoelectric element commonly used is a hollow piezoelectric cylinder having electrodes on its inner and outer circumferential surfaces. These cylinders operate to convert between electric potential and radial movement of the cylinder. However, these cylinders have certain problematic characteristics that reduce their suitability for underwater communication and reconnaissance. For instance, piezoelectric materials typically have a low tensile strength and can therefore break apart when subject to the large driving voltages often needed for generating large acoustical waves. This aspect of their operation is addressed in U.S. Pat. Nos. 4,220,887, issued Sep. 2, 1980 to H.W. Kompanek, 4,156,824, issued May 29, 1979 to E.A. Pence, Jr., 3,716,828, issued Feb. 13, 1973 to F. Massa, and 3,474,403, issued Oct. 21, 1969 to F. Massa et al. Typically, the risk of breakage of the piezoelectric cylinder is reduced or eliminated by limiting radial expansion of the cylinder through the use of a "pre-stress" wrap secured about the outer periphery of the cylinder. This pre-stress wrap provides a static, inwardly radial force on the cylinder.

Another problem encountered with the use of piezoelectric cylinders is that the conversion between electrical and acoustical energy is somewhat low at all but a number of resonant frequencies. The cylinder therefore has a high "Q" at these resonant frequencies. The cylinder has a number of resonant frequencies associated with it, including a wall thickness resonant frequency (the frequency at which the thickness of the cylinder wall undergoes its maximum oscillations), a length mode resonant frequency (the frequency at which the cylinder undergoes its maximum lengthwise oscillations), a radial mode resonant frequency (the frequency at which the diameter of the cylinder undergoes its maximum oscillations), and a cavity mode resonant frequency (a frequency dependent upon the length and diameter of the cylinder and the velocity of sound in the fluid disposed within the cylinder). Therefore, acoustical communication and detection by a simple piezoelectric cylinder is normally limited to a narrow band of frequencies located about these resonant frequencies.

The radial mode resonant frequency can be calculated according to the formula:

$$F_{radial} = \frac{1}{2\pi a} \times \frac{Y}{(1-\sigma)p},$$

where a is the mean radius of the cylinder, Y is Young's modulus of the ceramic, $\sigma$ is Poisson's ratio of the ceramic, and p is the density of the ceramic material. This resonant frequency can be raised or lowered by decreasing or increasing, respectively, the diameter of the piezoelectric cylinder. Another means for lowering the radial mode resonant frequency is to form a composite transducer by adding inertial masses about the outer periphery of the cylinder. See, for example, U.S. Pat. Nos. 4,823,327, issued Apr. 18, 1989 to H. Hilmers, 3,111,595, issued Nov. 19, 1963 to M.C. Junger, and 2,775,749, issued Dec. 25, 1956 to H. Sussman.

Alternatively, the aforementioned patent to Pence, Jr. purports to provide a composite transducer which lowers the radial mode resonant frequency several octaves below that of the cylinder alone. The transducer includes a cylindrical shell that is fitted over and which extends beyond the piezoelectric cylinder. The shell is slotted for part of its length from each end to form "leaves" which flex with radial expansion and contraction of the cylinder. One disadvantage of this device is that the free ends of the leaves can oscillate out of phase with the oscillations of the cylinder at certain frequencies, thereby causing phase-inverted oscillations that dampen the response of the transducer at those frequencies. The primary phase-inverted oscillation frequency can be predicted by the formula:

$$\text{Frequency} = \frac{c_s}{2L},$$

where $c_s$ is the sound velocity of the shell material and L is the length of the slotted shell.

The cavity mode resonant frequency is typically lower than the radial mode resonant frequency and can be calculated according to the formula:

$$F_{cavity} = \frac{\pi c_o}{L + 2\alpha r},$$

where L is the length of the ceramic cylinder, r is the inside radius of the ceramic, $\alpha$ is a frequency factor dependent upon the ratio of L to r, and $$c_o = c\left(1 + 2\frac{Br}{Yt}\right)^{-\frac{1}{2}},$$

in which B is the bulk modulus of water, c is the speed of sound in water, and t is the wall thickness of the cylinder.

Regardless of the frequency at which such transducers undergo their various resonances, it would be advantageous to broaden the frequency range over which there is efficient electroacoustical conversion. It would also be advantageous to maintain the Q of the transducer small across the broadened frequency range. This would permit the transducer to transmit and receive a wider range of acoustical information, thereby improving the operation of the transducers for their intended use as well as making any one transducer suitable for a broader range of applications.

SUMMARY OF THE INVENTION

The present invention provides a broadband electroacoustic transducer which provides an improved response over a relatively broad range of frequencies. This is accomplished by a transducer which includes a plurality of tines extending between the outer circumferential surfaces of a pair of piezoelectric cylinders. The cylinders are disposed about a common axis and are separated by a gap. Each tine extends longitudinally across the gap from one cylinder to the other and is separated from the adjacent tines by a space which is sized to prevent contact between the tines when the cylinders radially oscillate. A pre-stress wrap is disposed over the tines on both sides of the gap. These wraps provide a static, inwardly radial force and can be used to provide a mechanical bias on the tines so that the tines follow radial movements of the piezoelectric cylinders.

In an alternative embodiment, the transducer includes a piezoelectric cylinder and a plurality of longitudinally extending tines disposed in spaced relation about the outer circumferential surface of the cylinder. These tines extend beyond the ends of the cylinder and are fixed at their ends in a reference position, whereby the ends of the tines will not appreciably move radially with radial expansion or contraction of the piezoelectric cylinder. The ends of the tines may be fixed by any means, including, for example, a pair of rings connected at opposite ends of the transducer. Each ring can be used to connect each of the adjacent ends of the plurality of tines together. A pre-stress wrap is disposed over the tines about the cylinder, as in the first embodiment.

The present invention provides a broadband response by coupling the radial and cavity resonant frequencies to create a range of frequencies extending from just below the cavity mode resonant frequency to at least one octave above the radial mode resonant frequency. In the first embodiment, phase-inverted oscillations of the tines are eliminated because the ends of the tines follow the radial movement of the cylinders, thereby providing an improved response across the usable frequency range. In the alternative embodiment, the phase-inverted oscillations are eliminated by fixing the ends of the tines in a reference position.

BRIEF DESCRIPTION OF THE DRAWING

The preferred exemplary embodiments of the present invention will hereinafter be described in conjunction with the appended drawings, wherein like designations denote like elements, and.

DESCRIPTION OF THE PREFERRED EMBODIMENTS

Figure 1:
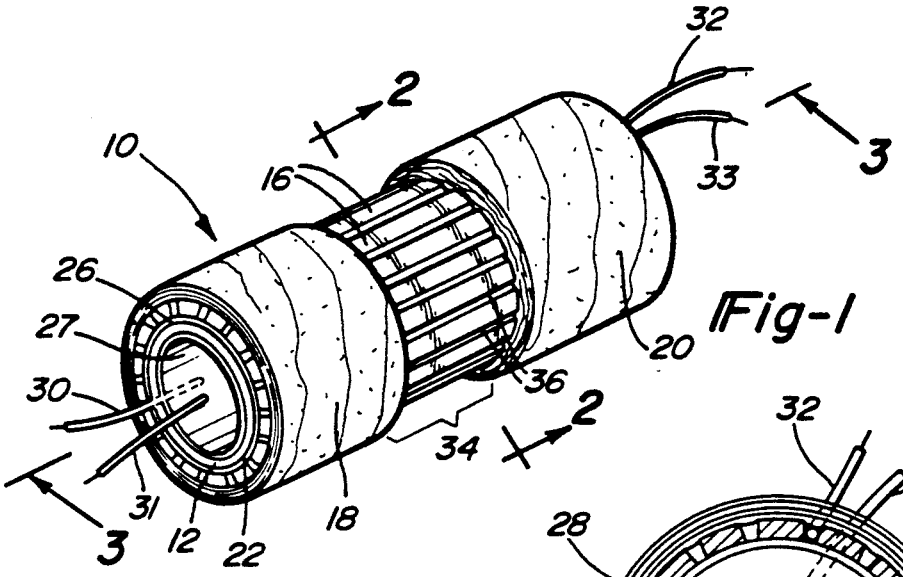
FIG. 1 is a perspective view of one embodiment of the transducer of the present invention.
Figure 2:
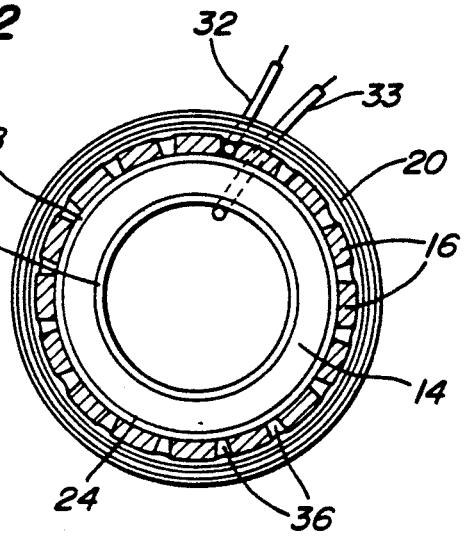
FIG. 2 is a cross-sectional view taken along the 2—2 line of FIG. 1.
Figure 3:
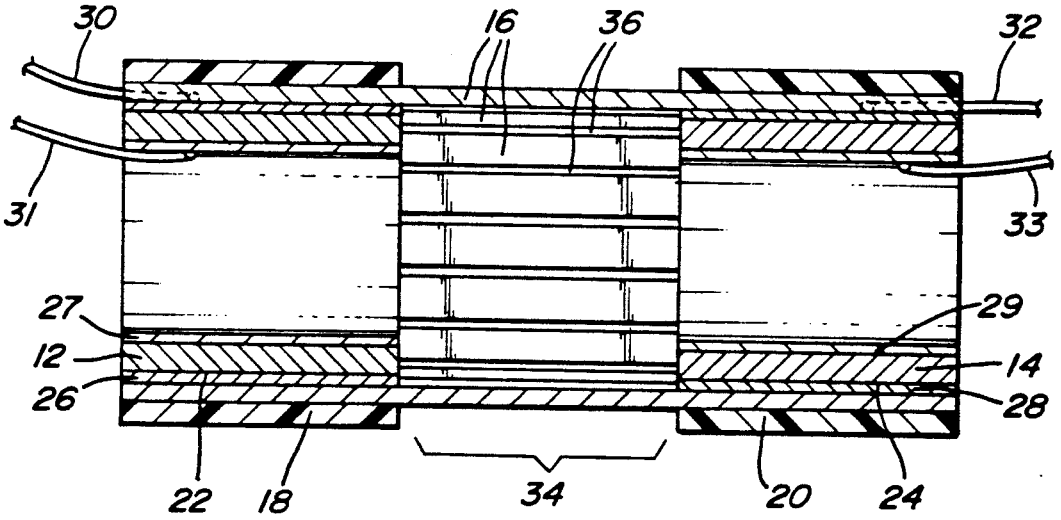
FIG. 3 is a cross-sectional view taken along the 3—3 line of FIG. 1.

As shown in FIGS. 1 through 3, a transducer of the present invention, designated generally as 10, includes first and second hollow piezoelectric cylinders 12, 14, a plurality of metal tines or bars 16 extending between cylinders 12, 14, and first and second pre-stress wraps 18, 20 disposed over tines 16 about cylinders 12, 14, respectively. Piezoelectric cylinders 12, 14 have outer circumferential surfaces 22, 24, respectively, about which tines 16 are disposed. Disposed on cylinder 12 are a pair of electrodes 26, 27 for providing driving voltages to and/or receiving detected voltages from cylinder 12. A similar pair of electrodes 28, 29 are located on cylinder 14. A pair of electrode leads 30, 31 are electrically connected to electrodes 26, 27, respectively, on cylinder 12 and a pair of electrode leads 32, 33 are electrically connected to electrodes 28, 29, respectively, on cylinder 14.

Cylinders 12, 14 are located about a common axis in spaced relation, such that a gap 34 is defined therebetween. Tines 16 are disposed in spaced relation on electrodes 26, 28 about surfaces 22, 24 to thereby define a number of spaces 36 equal in number to the number of tines utilized by transducer 10. Tines 16 extend across gap 34. Pre-stress wraps 18, 20 extend the length of cylinders 12, 14, respectively, and provide an inwardly radial force, as hereinafter described in more detail. Thus, as shown in FIG. 2, cylinders 12, 14, the group of tines 16, and pre-stress wraps 18, 20 are coaxially disposed.

Preferably, cylinders 12, 14 are equal in length, radius, and wall thickness. The length and radius can be chosen to provide operation over a frequency range of interest. Preferably, the length to radius ratio of cylinders 12, 14 is in the range of 0.8 to 1.2. A smaller length to radius ratio results in an increased separation and higher Q of the radial and cavity resonant frequencies, resulting in less efficient conversion between acoustical and electrical energy at the intervening frequencies.

Preferably, tines 16 extend the entire length of cylinders 12, 14, although it will be understood by one skilled in the art that tines 16 need only extend over surfaces 22, 24 to the extent necessary to insure that movement of the ends of tines 16 is limited to radial movement of cylinders 12, 14. Tines 16 can be made from any stiff, flexible material, such as brass, aluminum, steel, or stainless steel. Tines 16 are fixed on electrodes 26, 28 about outer circumferential surfaces 22, 24 by any suitable means, such as an epoxy. Alternatively, pre-stress wraps 18, 20 can be used to mechanically bias tines 16 against electrodes 26, 28, respectively, to eliminate the need for attaching tines 16 to electrodes 26, 28 by epoxy or the like. Eliminating epoxy between tines 16 and electrodes 26, 28 eliminates many of the problems associated with using epoxies, such as fracturing of the epoxy bond when the transducer is subjected to large driving voltages. If no epoxy is used, the static, inwardly radial load provided by pre-stress wraps 18, 20 should be selected to maintain continuous contact between tines 16 and electrodes 26, 28 at the maximum radial contraction expected for the intended use of transducer 10.

Tines 16 can have the cross-sectional shape of a sector of an annulus that conforms to the curvature of surfaces 22, 24. Alternatively, tines 16 can have a simple rectangular or other cross-sectional shape and, assuming a large enough number of tines are used, the difference in curvature of the surfaces of electrodes 26, 28 from the contacting surface of tines 16 will be of little or no effect. The number of tines 16 used is not critical; however, if only a very few tines (e.g., four) are used and spaces 36 are kept very small, then there will be insufficient flow of fluid through spaces 36 to provide proper coupling of the cavity and radial resonance modes, as will be hereinafter explained in more detail. It is preferable that at least eight tines be used and even more preferable that the number of tines 16 utilized be in the range of twelve to thirty. In a highly preferred embodiment, sixteen tines are used.

It is preferable, but not critical, that tines 16 be equidistantly spaced about outer circumferential surfaces 22, 24, whereby the width of spaces 36 will be equal. In a like manner, it is preferable though not necessary that tines 16 each have the same length, width, and thickness. Each of the tines 16 should be spaced from the remaining tines by a distance sufficient to prevent each of the tines 16 from contacting the remaining tines when cylinders 12, 14 contract radially inwardly. Preferably, tines 16 extend parallel to the axis of cylinders 12, 14, although tines 16 can extend somewhat helically between cylinders 12 and 14. Additionally, tines 16 need not be separate elements, but could be formed by longitudinally slotting a cylindrical sleeve along a central region thereof, such that tines 16 would be integrally joined at their ends. Other such variations will be apparent to those skilled in the art.

While the dimensions of cylinders 12, 14 are selected primarily in accordance with the desired cavity and radial mode resonant frequencies, the length of gap 34 and, therefore, the length of tines 16 is determined by other constraints. The length of gap 34 should not be so small that coupling of the cavity and radial resonant modes is greatly diminished, but should not be so large that tines 16 are able to oscillate out of phase with cylinders 12, 14 within the usable frequency range of transducer 10. Depending upon the stiffness of the material used for tines 16, if the length of gap 34 is made too large, oscillations of cylinders 12, 14 at certain frequencies could cause nodes to form in the oscillations of tines 16 within gap 34, thereby producing a phase-inverted oscillation which will dampen the response of transducer 10. Preferably, the length of gap 34 is approximately equal to the length of cylinder 12, which, as mentioned above, is preferably equal to the length of cylinder 14.

Electrodes 26–29 permit electrical energy to be transmitted to and/or detected from the surfaces of cylinders 12, 14. Preferably, electrodes 26, 28 cover outer circumferential surfaces 22, 24 of cylinders 12 and 14, respectively, and electrodes 27, 29 cover the inner circumferential surfaces of cylinders 12 and 14, respectively. Tines 16 are therefore disposed about outer circumferential surfaces 22, 24 in contact with electrodes 26 and 28. Alternatively, electrodes 26, 27 and 28, 29 can be located about only the inner circumferential surfaces or only outer circumferential surfaces 22 and 24 of cylinders 12 and 14, respectively, and can be electrically isolated by a small gap. Electrodes 26–29 can suitably be very thin, electrically conductive layers formed by electrolytic deposition, as will be known to those skilled in the art.

If any of the electrodes 26–29 are disposed on outer circumferential surfaces 22, 24 an insulative layer can be placed between those electrodes and tines 16 to prevent undesirable electrical shorting of those electrodes to each other through tines 16. However, as discussed below, in the preferred embodiment shown in FIGS. 1 through 3, electrodes 26, 28 are driven by a common signal so that no such insulative layer is necessary.

Electrode leads 30–33 permit electrical signals to be transmitted to and from cylinders 12, 14. As best seen in FIGS. 1 and 3, electrode lead 31 simply enters the center cavity of cylinder 12 and is electrically connected to electrode 27, whereas electrode lead 30 must extend along one of the spaces 36 between a pair of adjacent tines 16 to the point at which it is electrically connected to electrode 26. Attachment of leads 32, 33 to electrodes 28, 29, respectively, is similar for cylinder 14. Leads 30–33 can be electrically connected to electrodes 26–29 by solder or other suitable means. When used to transmit acoustical information, cylinders 12, 14 are preferably driven in phase and, even more preferably, are driven by the same signal. Thus, electrode 26 can be connected to electrode 28 and electrode 27 can be connected to electrode 29, thereby eliminating the need for separately connecting electrode leads 31 and 32 to the electrical apparatus (not shown) driving or sensing radial movements of cylinders 12, 14.

As previously mentioned, pre-stress wraps 18, 20 provide a static, inwardly radial force on cylinders 12, 14 which allows cylinders 12, 14 to undergo large radial expansions without breakage. The particular means employed to preload cylinders 12, 14 is not at all pertinent to the present invention. Suitable means of preloading cylinders 12, 14 include steel wire or fiberglass roving. The amount of radially compressive force can be selected in accordance with the magnitude of radial expansion and contraction expected for the intended use of transducer 10.

Transducer 10 can be disposed in a fluid filled housing (not shown) or encapsulated (not shown) in the usual manners known to those skilled in the art. The response of transducer 10 will thereby be made relatively independent of static pressure and transducer 10 can therefore be used at almost any depth of water. As indicated in the equation for $F_{cavity}$, the viscosity of the fluid or encapsulant will affect the cavity mode resonance frequency.

When operating as an acoustical transmitter, piezoelectric cylinders 12, 14 are driven by an electrical potential applied to electrodes 26–29 via leads 30–33. Radial movement of cylinders 12, 14 causes identical, simultaneous movement of the ends of tines 16. However, movement of the centers of tines 16, which are disposed in gap 34, is restricted due to their inertia and to the resistance to their movement attributable to the medium (e.g., water) in which transducer 10 is placed. Depending upon the stiffness, mass, and cross-sectional shape of tines 16, the length of gap 34, and the viscosity of the medium, the portions of tines 16 disposed along gap 34 may flex in a manner similar to that of the "leaves" shown and described in the aforementioned U.S. Pat. No. 4,156,824 to Pence, Jr., hereby incorporated by reference. However, the present invention operates to restrict movement of the ends of tines 16 to that of the radial movement of cylinders 12, 14, thereby reducing or eliminating frequency-specific phase-inverted oscillations which dampen the response over the frequency range.

Transducer 10 provides a relatively broadband response to acoustical and electrical stimulation because tines 16 and spaces 36 operate to lower the Q of transducer 10 at the radial and cavity resonant frequencies, while coupling these two resonances together, thereby providing a relatively flat response over the frequency range of transducer 10 (i.e., over the frequency range extending between these two resonant peaks). The cavity and radial mode resonant frequencies can be chosen in accordance with the formulas provided above. In this way, the frequency range of transducer 10 can be selected as desired. If the cavity and radial mode resonant frequencies are chosen to be relatively close, the response will be flatter across the frequency range, although the resulting bandwidth of transducer 10 will be narrower. Conversely, if these resonant frequencies are chosen to be farther apart, transducer 10 will have a larger usable bandwidth, but at the expense of efficient conversion between acoustical and electrical energy at intervening frequencies.

Figure 4:
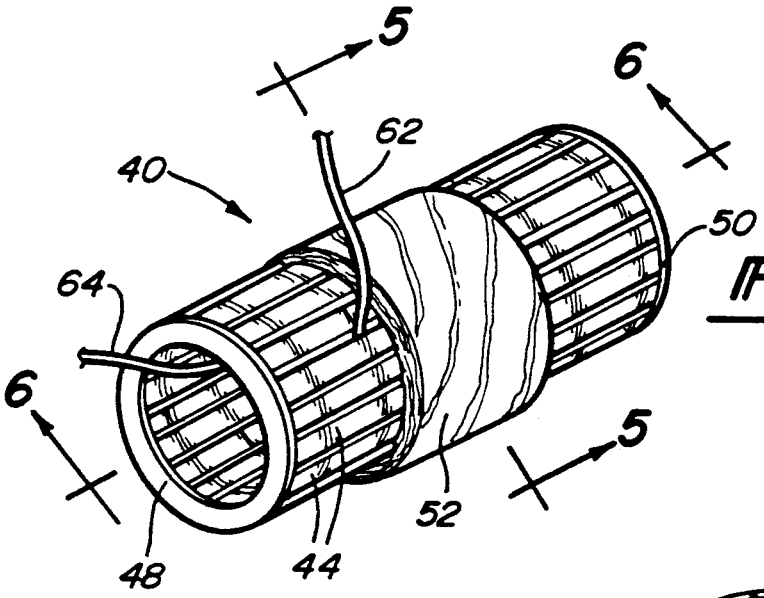
FIG. 4 is a perspective view of an alternative embodiment of the transducer of the present invention which utilizes a single piezoelectric cylinder.
Figure 5:
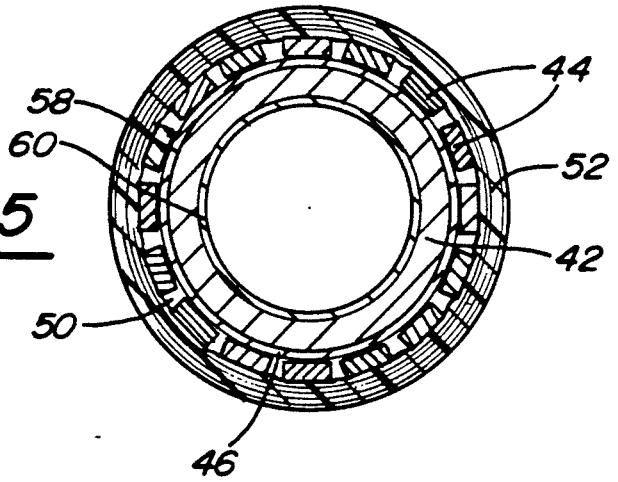
FIG. 5 is a cross-sectional view taken along the 5—5 line of FIG. 4.
Figure 6:
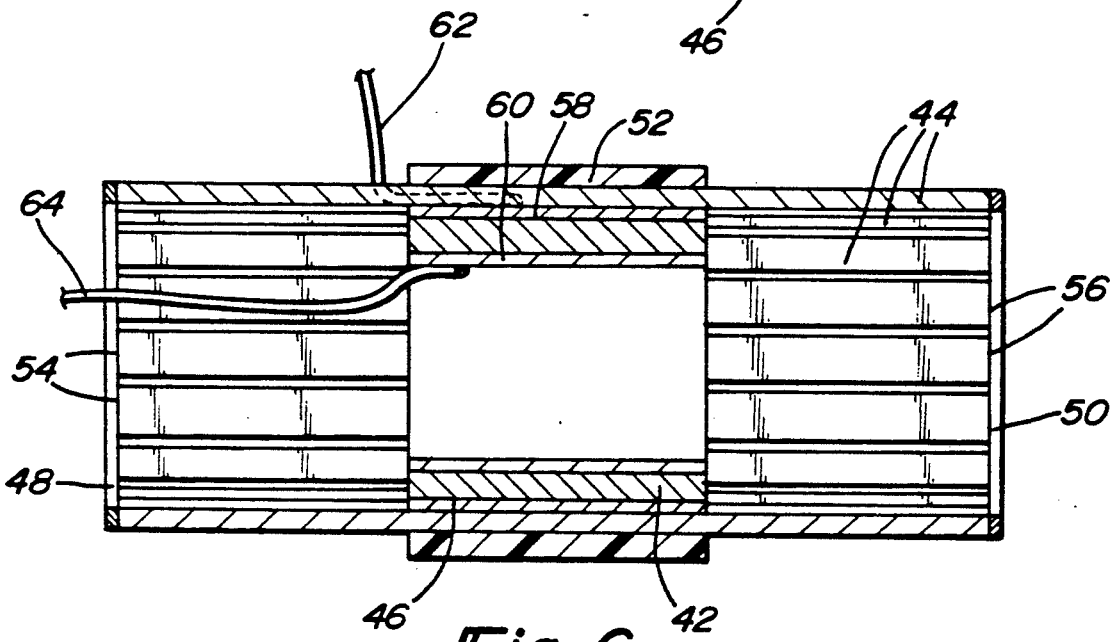
FIG. 6 is a cross-sectional view taken along the 6—6 line of FIG. 4.

FIGS. 4 through 6 depict an alternative embodiment of the present invention. A transducer, designated generally as 40, includes a hollow piezoelectric cylinder 42, a plurality of longitudinally extending tines 44 disposed about an outer circumferential surface 46 of cylinder 42, a pair of end rings 48, 50, and a pre-stress wrap 52 disposed over tines 44 in a central region thereof to provide an inwardly radial force on cylinder 42. Tines 44 each have a pair of opposite ends 54, 56. Ends 54 of tines 44 are rigidly connected to ring 48 and ends 56 are rigidly connected to ring 50. Cylinder 42 has a pair of electrodes 58, 60 which are electrically connected to a pair of electrode leads 62, 64, respectively.

Cylinder 42, pre-stress wrap 52, electrodes 58, 60, and leads 62, 64 of transducer 40 are all functionally and structurally similar to the corresponding parts of transducer 10 and all the aforementioned considerations involving those parts are relevant to transducer 40. Tines 44 are similar in structure and function of tines 16, except that they are rigidly fixed in a reference position at ends 54, 56 by rings 48, 50, respectively. Thus, whereas tines 16 are restricted at their ends to radial movement of piezoelectric cylinders 12, 14, tines 44 are restricted at a central region thereof to follow radial movement of cylinder 42, with ends 54, 56 substantially restricted from radial movement altogether. Fixing ends 54, 56 in a reference position helps prevent them from undergoing phase-inverted oscillations at certain frequencies which dampen the response of transducer 40 at those frequencies. As with transducer 10, this gives transducer 40 an improved response over its usable frequency range.

Ends 54, 56 of tines 44 can be fixed in a reference position by any suitable means. For example, instead of rings 48, 50, ends 54, 56 can be rigidly secured to opposing walls of a housing for transducer 40. Additionally, tines 44 can be part of a unitary structure that includes the means used to secure them in their reference position. Tines 44 can also suitably be formed from a tubular sleeve slotted inwardly from both ends. Preferably, tines 44 have a length at least twice the length of cylinder 42.

EXAMPLE

A transducer similar to transducer 40 was constructed using the following components:

PZT-4 ceramic cylinder
length=1.375"
outside diameter=2.92"
wall thickness=0.150"
manufactured by EDO Corporation of Salt Lake City, Utah
Aluminium slotted sleeve
6061-T6 aluminum
length=4.125"
outside diameter=3.25"
wall thickness=0.125"
Aluminum end rings
length=0.125"
outside diameter=3.125"
width=0.09"
Steel wire pre-stress wrap
diameter=0.010"
compressive stress=5600 psi
Lexan TM housing
length=5.0"
outside diameter=4.5"
wall thickness=0.25"
filled with DB castor oil filling fluid The aluminum sleeve included 32 tines formed at each end of the sleeve by longitudinally slitting the sleeve in 32 locations spaced about its circumference. The transducer was suspended in the oil-filled Lexan TM housing by a pair of nylon support plates that compressively held the ceramic cylinder by its ends.

The foregoing example is provided by way of illustration only and is not intended to limit the scope of the appended claims. Moreover, it will be understood that the foregoing description is of preferred exemplary embodiments of the invention and that the invention is not limited to the specific embodiments shown. Various changes and modifications will be obvious to those skilled in the art and all such variations and modifications are intended to come within the spirit and scope of the appended claims.

I claim:

1. A broadband acoustic transducer, comprising:

first and second piezoelectric cylinders disposed in spaced relation about a common axis to define a gap therebetween; and a plurality of tines extending generally parallel to said axis across said gap from said first cylinder to said second cylinder, said tines being disposed in spaced relation about the outer circumferential surfaces of said first and second cylinders;

opposite ends of said tines being coupled to said first and second cylinders to move radially with radial movement of said cylinders.

2. A transducer as defined in claim 1, further comprising pre-stress means, disposed over said tines about the outer circumferential surface of said first and second cylinders, for providing an inwardly radial force on said cylinders.

3. A transducer as defined in claim 2, further comprising an inner electrode disposed on the inner circumferential surface of said first and second cylinders and an outer electrode disposed on said outer circumferential surfaces of said first and second cylinders, wherein said tines are disposed about said outer circumferential surfaces on said outer electrodes.

4. A transducer as defined in claim 2, wherein said tines comprise metal bars, each of said bars spaced from the remaining bars by a distance sufficient to prevent each of said bars from contacting the remaining bars when said cylinder contracts radially inwardly.

5. A transducer as defined in claim 4, wherein the transducer includes at least eight of said bars.

6. A broadband acoustical transducer, comprising:

a first piezoelectric cylinder;

a second piezoelectric cylinder having a diameter equal to the diameter of said first cylinder and a length equal to the length of said first cylinder, said second cylinder being disposed about the axis of said first cylinder and being spaced from said first cylinder to define a gap therebetween;

a plurality of metal tines having first and second ends and a substantially rectangular cross-sectional shape, said tines extending substantially parallel to said axis across said gap from the outer circumferential surface of said first cylinder to the outer circumferential surface of said second cylinder, each of said tines being spaced from the remaining tines by a distance sufficient to prevent each of said tines from contacting the remaining tines when said first and second cylinders contract radially inwardly;

a first pre-stress wrap disposed over said tines about the outer circumferential surface of said first cylinder to provide an inwardly radial force on said tines and said first cylinder; and a second pre-stress wrap disposed over said tines about the outer circumferential surface of said second cylinder to provide an inwardly radial force on said tines and said second cylinder.

7. A broadband acoustic transducer, comprising:

a housing;

a piezoelectric cylinder suspended in said housing;

a plurality of longitudinally extending tines having first and second ends and disposed in spaced relation about the outside circumferential surface of said cylinder, said tines extending beyond one end of said cylinder such that said first ends are located remotely of said cylinder;

securement means for limiting radial movement of said first ends of said tines; and a liquid filling said housing and said cylinder.

8. A transducer as defined in claim 7, wherein each of said tines extends beyond the other end of said cylinder such that said second ends are located remotely of said cylinder and wherein said securement means fixes said first and second ends in a reference position, whereby the position of said first and second ends is substantially independent of radial movement of said cylinder.

9. A transducer as defined in claim 8, wherein said cylinder comprises a piezoelectric material having a pair of electrodes and said tines comprise a metal alloy.

10. A transducer as defined in claim 8, further comprising pre-stress means, disposed over said tines, for providing an inwardly radial force on said cylinder.

11. A transducer as defined in claim 10, wherein said securement means comprises first and second rings, said first ring being rigidly connected to each of said first ends and said second ring being rigidly connected to each of said second ends.

12. A transducer a s defined in claim 10, wherein said tines are secured about the outer circumferential surface of said cylinder by said pre-stress means.

* * * * *